United States Patent [19]

Kuo

[11] Patent Number: 4,617,688

[45] Date of Patent: Oct. 21, 1986

[54] TOILET HAVING ADJUSTABLE WATER-SPRAY NOZZLES

[76] Inventor: Dai-Ming Kuo, P. O. Box 10160, Taipei, Taiwan

[21] Appl. No.: 779,833

[22] Filed: Sep. 25, 1985

[51] Int. Cl.[4] ..... A47K 3/20

[52] U.S. Cl. ..... 4/420.2; 4/420.4; 4/447

[58] Field of Search ..... 4/443–448, 4/420.1–420.5

[56] References Cited

U.S. PATENT DOCUMENTS

| | | | |
|---|---|---|---|
| 2,058,003 | 10/1936 | Davies | 4/420.1 X |
| 2,104,271 | 1/1938 | Parisini | 4/448 |
| 3,015,826 | 1/1962 | Aranas | 4/420.4 |
| 3,916,453 | 11/1975 | Dominguez-Armada | 4/445 |
| 3,947,899 | 4/1976 | Robinson et al. | 4/420.2 X |
| 4,551,867 | 11/1985 | Gurevich et al. | 4/420.5 X |

*Primary Examiner*—Charles E. Phillips

[57] ABSTRACT

A toilet includes a warm water source, two valves controlling two branch water conduits directing water from the water source, a rear-side nozzle, a front-side nozzle, and two spraying-angle adjuster, in that each spraying-angle adjuster includes a bellows fluidically connected with an air tube and a hollow ball so that the depression of ball may expand the bellows to adjust the water-spray angle of either nozzle for thoroughly cleaning the anus or genitals of the toilet user.

1 Claim, 2 Drawing Figures

TOILET HAVING ADJUSTABLE WATER-SPRAY NOZZLES

BACKGROUND OF THE INVENTION

Conventional toilet provided with water-spray nozzles as disclosed in U.S. Pat. No. 4,422,190 by C. C. Huang may spray warming water towards the anus or genitals of the toilet user. However, such a water-spray nozzle is designed to have a fixed angle for water spraying. Whenever washing the anus or genitals portions of a toilet user, he or she must adjust his or her pose to allow the anus or genitals portion being flushed by the spraying water, to thereby cause inconvenience or incomplete cleaning for the toilet user.

The present inventor has found the defects of conventional toilet and invented the present toilet having adjustable water-sray nozzles.

SUMMARY OF THE INVENTION

The object of the present invention is to provide a toilet having a warm water source, two valves controlling two branch conduits, a rear-side nozzle, a front-side nozzle and two spraying angle adjusters respectively adjusting the water-spraying angles of the two nozzles so that the anus or genitals of toilet user may be thoroughly washed by optionally adjusting the water-spraying angles.

DETAILED DESCRIPTION

Figure 1:
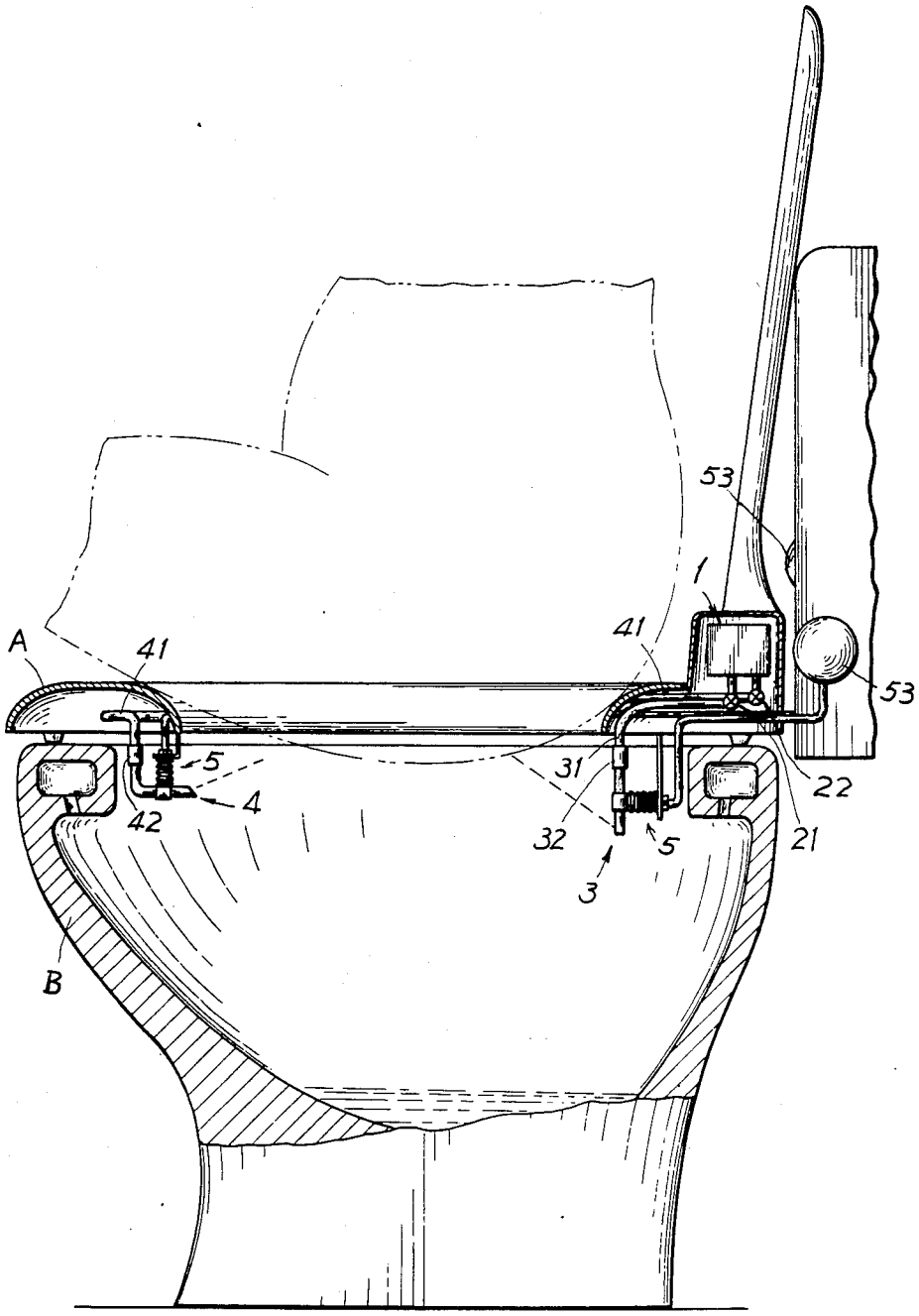
FIG. 1 is an illustration showing the assembly of the present invention.

As shown in the figures, the present invention comprises a warm water source 1; two valves 21, 22 controlling two branch conduits 31, 41 directing water from source 1 to the two nozzles 3, 4; a rear-side nozzle 3 adapted for spraying human anus; a front-side nozzle 4 adapted for spraying human genitals; and two spraying-angle adjusters 5, each securing either nozzle 3 or 4.

The warm water source 1 is not shown in detail in the present invention, which can be obtained by incorporating an electric heating coil in the water source and is separated into two branch water conduits 31, 41 respectively connected to the two nozzles 3, 4 and respectively controlled by two valves 21, 22.

Figure 2:
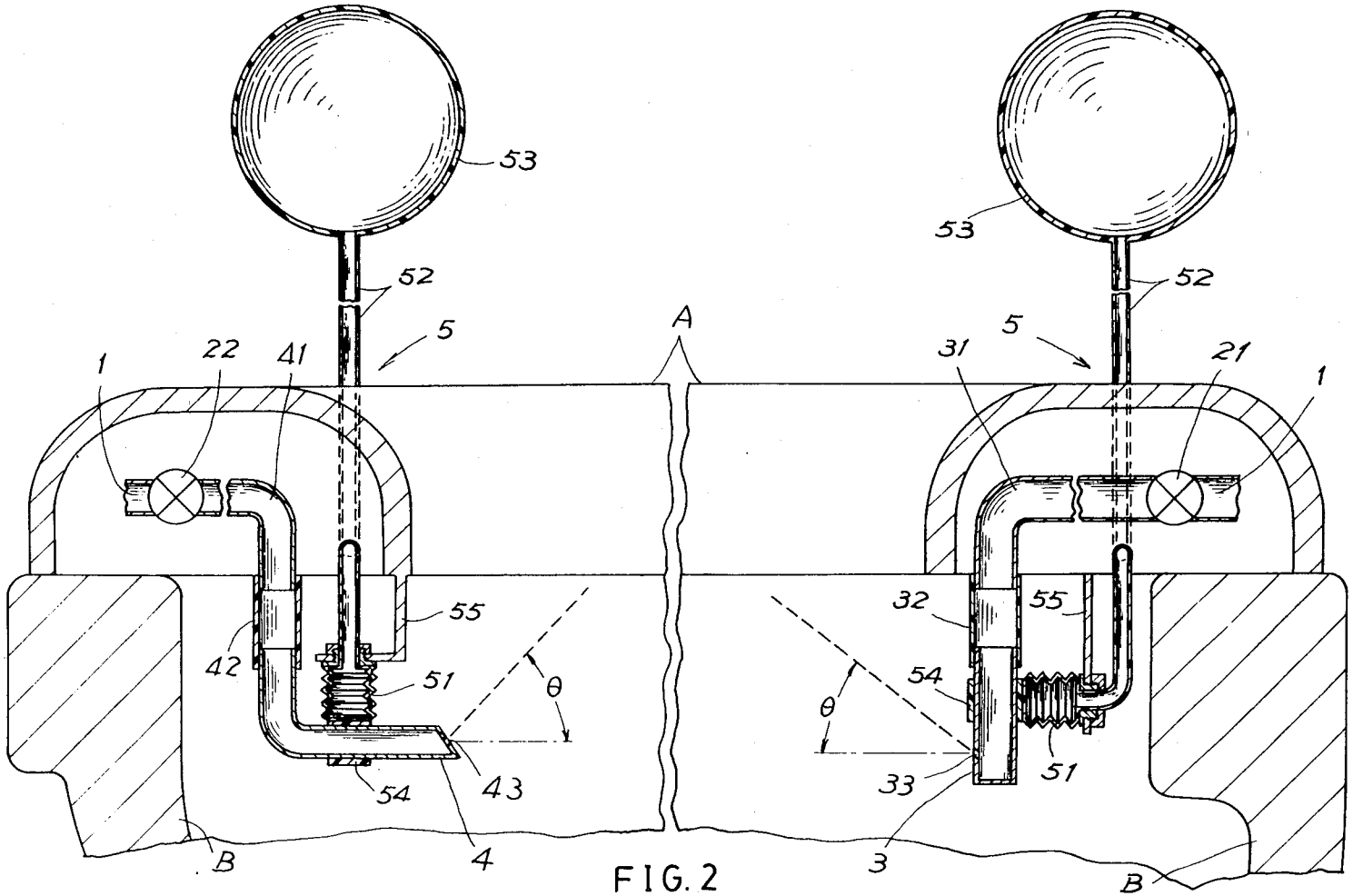
FIG. 2 is a sectional drawing of the present invention.

The rear-side nozzle 3 includes a water conduit 31, a flexible portion 32 formed on the conduit 31 and a water-spray hole 33 having fixed spraying angle, such as $\theta$ shown in FIG. 2. Each spraying-angle adjuster 5 includes a bellows 51 having a collar 54 for fixing either nozzle 3 or 4 within the collar, an air tube 52 fluidically connected with the bellows 51 and secured to the toilet seat A riding on bowl B by a bracket 55, and a hollow ball 53 fluidically connected with the tube 52.

One spraying-angle adjuster 5 is connected with the rear-side nozzle 3 and another adjuster 5 is connected with the front-side nozzle 4.

When using the present invention, the rear-side nozzle 3 can be operated by depressing the ball 53 to operatively expand the bellows 51 by the compression of air filled within the tube 52 and ball 53 so as to raise the nozzle 3 and move the water-spraying direction rearwards. After releasing the depression of ball 53, the bellows 51 can be recovered to retract the nozzle 3 to its original position. By optional adjusting the angle of the nozzle 3, the user's anus can be completely washed for sound hygienic purpose.

Similarly, the front-side nozzle 4 can be freely adjusted by actuating another spraying-angle adjuster 5 at the front side of toilet seat A to thoroughly flush and clean the user's genitals portion. All nozzles 3, 4 are positioned within the bowl B. But the balls 53 are preferably provided at the rear side of toilet and near the water tank T for convenient operation and for esthetic purpose.

The present invention has the following advantages superior to conventional toilet provided with water-spray nozzles:

1. The water-spraying angle can be optionally adjusted for complete cleaning of user's anus or genitals portions.

2. The adjusting method is simple as merely operated by hand and its construction is also simple for easier installation and reduced cost.

I claim:

1. A toilet having a seat and adjustable water-spray nozzles comprising:

a warm water source;

two valves respectively controlling two branch water conduits directing water from said water source to a rear-side nozzle and a front side-nozzle said rear-side nozzle adapted for spraying the human anus, and having a flexible portion on said conduit and a water-spray hole with a fixed spraying angle in said conduit;

said front-side nozzle adapted for spraying the human genitals and having a flexible portion on said conduit and a water-spray hole with fixed spraying angle in said conduit;

a spraying-angle adjuster including a bellows having means for connecting to any one of said nozzles, an air tube fluidically connected with said bellows and secured to said toilet seat by a bracket, and a hollow ball fluidically connected with said air tube, whereby when said ball is depressed said bellows will expand and cause movement of said nozzle about said flexible portion of said water conduit to optionally adjust the water-spraying angle of said nozzle for thoroughly cleaning either the human anus or genitals portions.

* * * * *